United States Patent [19]

Daniel

[11] Patent Number: 4,763,450

[45] Date of Patent: Aug. 16, 1988

[54] ICE DAM PREVENTER

[76] Inventor: Gordon S. Daniel, 5614 NW. 87th Ter., Apt. 251, Kansas City, Mo. 64154

[21] Appl. No.: 37,714

[22] Filed: Apr. 13, 1987

[51] Int. Cl.[4] ..... E04D 13/00; F24J 3/02

[52] U.S. Cl. ..... 52/24; 126/417; 165/47

[58] Field of Search ..... 52/24–26, 52/11, 12; 165/47; 126/417, 450

[56] References Cited

U.S. PATENT DOCUMENTS

| | | | |
|---|---|---|---|
| 2,129,833 | 9/1938 | Fradette | 52/24 |
| 3,366,168 | 1/1968 | Dale | 165/47 |
| 3,388,738 | 6/1968 | Dery | 52/24 X |
| 4,252,183 | 2/1981 | Ricciadelli | 165/47 |
| 4,261,417 | 4/1981 | Tingley | 165/47 |
| 4,432,341 | 2/1984 | Howe et al. | 52/11 X |

*Primary Examiner*—J. Karl Bell

*Attorney, Agent, or Firm*—D. A. N. Chase

[57] ABSTRACT

Roof-mounted devices for providing drainage channels through ice dams that may form on a roof under winter conditions are spaced along the margin of the roof, each device comprising an elongated, heat-collecting metal plate which is installed in a transversely upright position between an adjacent pair of shingles. The plate extends longitudinally in a downward direction along the slope of the roof with its lower end portion projecting clear of the roof. Opposed, major vertical surfaces are thus presented by the plate and are black in color to maximize the collection of solar energy thereby causing a drainage channel to form along the surfaces through dams of ice or snow.

6 Claims, 1 Drawing Sheet

ICE DAM PREVENTER

This invention relates to the establishment of drainage channels through ice dams which, under winter conditions, may form on the margins or eaves of sloping roofs and, in particular, to a practical and inexpensive heat-collecting device installed on the roof which does not require a power source but which is capable of opening such a channel through ice dams that may be formed.

In both temperate and cold climates where significant snowfalls occur during the winter season, ice dams sometimes form on the edges of roofs when heat from the house or building interior penetrates to the roof and melts snow as it falls or after it has accumulated. Snow on the central portion of the roof away from the edges or eaves is particularly affected, both by interior heat and by solar energy once the storm passes and the skies clear. The snow melt flows down the roof to the colder eaves where, due to the presence of an exterior wall, the snow does not melt as rapidly. The result is that the water and the snow along the eaves or margin of the roof freeze into an ice dam that can cause water to accumulate on the roof behind the dam. The resulting damage to the structure can be significant as the water may back up under the shingles and leak into the interior.

Besides physically chopping the ice dams away, a solution to the problem in present use involves the installation of waterproof electric heating cables near the gutters of the roof. This is effective in melting the snow at the edge of the roof but is not an inexpensive installation and requires the continual expense of electrical power consumption. Furthermore, the electric cables are subject to weathering and thus constitute a hazard and must be periodically replaced.

Also, it has been proposed that solar powered devices be mounted along the edge of the roof of a building to melt passages through the ice dams, such as disclosed in Tingley, U.S. Pat. No. 4,261,417. However, such devices are too complex and expensive for widespread use, particularly since a number of the devices must be spaced along the edge of the roof in order to be effective.

It is, therefore, the primary object of the present invention to provide a heat-collecting device powered primarily by solar energy which is simple and inexpensive in construction, easy to install on shingled roofs and aesthetically pleasing, and which is capable of forming an effective drainage channel through an ice dam.

As a corollary to the foregoing object, it is an important aim of this invention to provide such a device in the form of a single heat-collecting plate of conductive material installed in an upright attitude at the margin of the roof, and which extends along the slope of the roof to provide a downwardly directed drainage channel for gravity flow of the melt.

Another important object of the present invention is to provide a plate as aforesaid having opposed major surfaces exposed to ambient heat energy, wherein such surfaces lie substantially in an upright plane and extend along the slope of the roof to provide the drainage channel.

Still another important object of this invention is to provide a plate as aforesaid which may be readily installed without special tools and, more specifically, to provide such a plate which is installed on the roof through the utilization of a mounting strip along its lower longitudinal edge that permits the plate to be disposed in an upright position between two adjacent shingles by insertion of the mounting strip beneath the shingles.

Other objects will become apparent as the detailed description proceeds.

DETAILED DESCRIPTION

Figure 1:
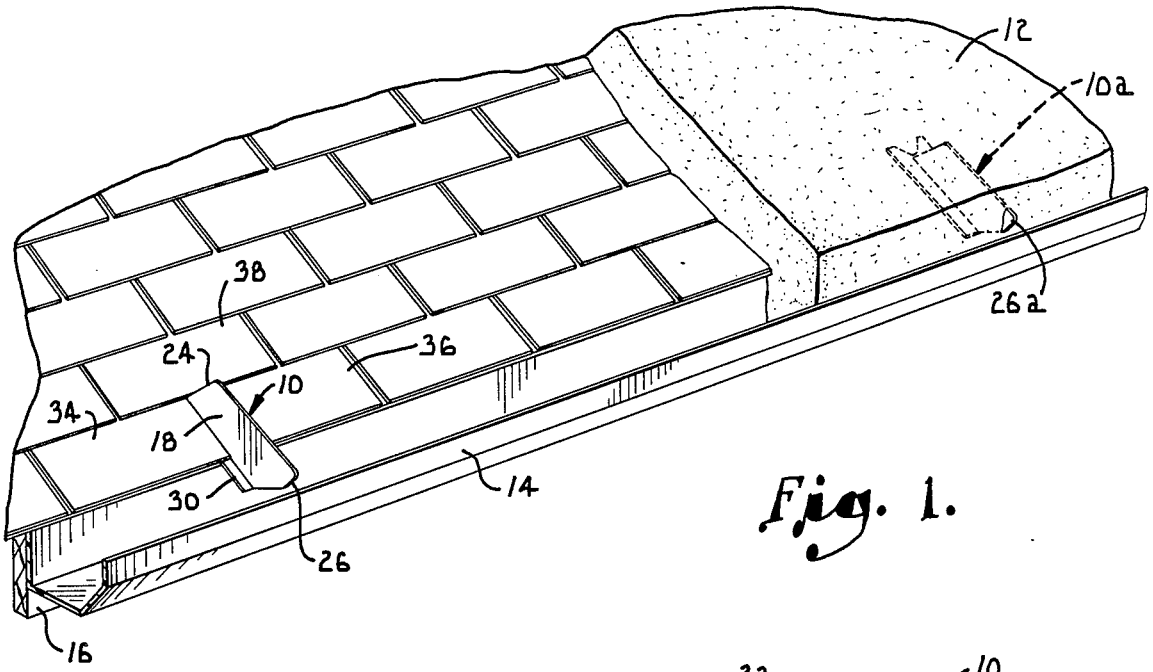
FIG. 1 is a fragmentary, perspective view of the edge of a shingled roof showing two of the devices of the present invention in place thereon, the device on the right being shown in phantom lines beneath a layer of snow that has accumulated on the roof.

A portion of a shingled roof is shown in FIG. 1 and has two of the heat-collecting devices 10 and **10*a* of the present invention installed thereon at the margin of the roof. The device 10*a* is shown in mostly phantom lines as it is largely hidden beneath a snow cover 12 which is broken away to reveal the device 10 in full lines. The usual gutter 14 is disposed beneath the edge of the roof for the purpose of carrying away water flowing therefrom to a downspout (not shown). Although the particular roof construction illustrated in FIGS. 1 and 3 does not employ overhanging eaves, the presence of an exterior wall 16** causes a cold zone to be formed at the margin of the roof and, therefore, in climates where significant winter snowfalls may be expected, provides a condition susceptible to the formation of ice dams.

Figure 2:
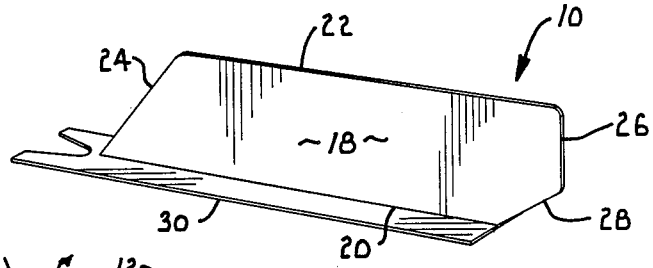
FIG. 2 is a perspective view of the device itself removed from the roof.
Figure 3:
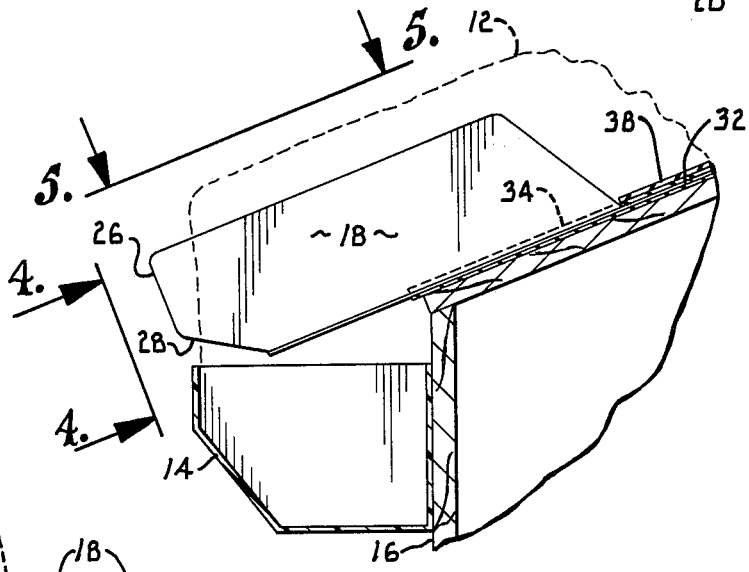
FIG. 3 is a vertical sectional view through an exemplary building structure showing the heat-collecting device of the present invention installed thereon, a layer of snow being outlined in broken lines.
Figure 5:
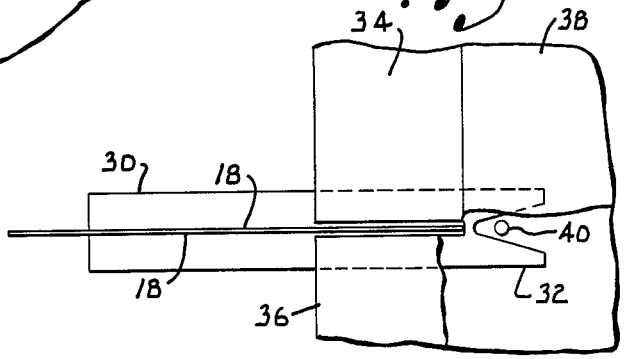
FIG. 5 is a view looking downwardly at a right angle to the slope of the roof as illustrated by line 5—5 in FIG. 3, the gutter being removed for clarity and a portion of the roof structure being broken away to reveal the projecting upper end of the mounting strip.

Referring particularly to FIGS. 2, 3 and 5, the device 10 comprises an elongated metal plate presenting opposed, black surfaces 18 that lie substantially in a vertical plane. The plate 18 is typically about one foot (30 cm.) in length and about four inches (10 cm.) in transverse dimension from its lower longitudinal edge 20 to its upper longitudinal edge 22, both of which are straight and in parallelism with each other. Although the plate could be of rectangular configuration, the shape illustrated in the preferred embodiment deviates from a rectangle in that it is provided with a sloping leading edge 24 and a tail 26 relieved at 28 to clear the gutter 14.

The heat-collecting plate is integral with a mounting strip 30 at its lower longitudinal edge 20. Particularly in FIGS. 4 and 5, it may be seen that the plate, and hence the opposed major surfaces 18 thereof, is perpendicular to the strip 30 at the longitudinal center line of the strip thereby imparting an inverted T-shaped, transverse configuration to the combination plate and strip. The strip 30 extends along the entire length of the longitudinal edge 20 and beyond the leading edge 24 to present a notched upper end 32. With respect to the manner of construction of the device 10, an extrusion of anodized black aluminum is preferred. An Alclad 3004 grade of aluminum has been found to be satisfactory, although other heat-conductive, metallic materials may be employed if desired.

As an alternative to extrusion, the plate and mounting strip may be formed as separate pieces and suitably joined by providing a flange at the lower edge 20 and bording the flange to the strip 30 by suitable means.

The devices 10 of the present invention are spaced along the margin of the roof at intervals of approximately four to five feet (1½ meters). Each device is readily installed by simply sliding it in place between a pair of adjacent shingles. More particularly, as shown in detail in FIGS. 3–5 with respect to the device 10 in FIG. 1, the upstanding plate, being of sheet material and hence relatively thin, is installed between the edges of adjacent shingles 34 and 36. The projecting, notched end 32 of strip 30 is initially inserted beneath the shingles 34 and 36 and the device is then fully inserted until the leading edge 24 abuts the adjacent shingle 38 of the next row thereabove. The notch provides clearance for a roofing nail 40 (FIG. 5) which would typically be encountered. Accordingly, no tools or special equipment are required as the devices 10 are simply slipped into position by hand and held by the friction of the shingles against the mounting strip 30 that is sandwiched between the shingles and the underlying roofing material.

Figure 4:
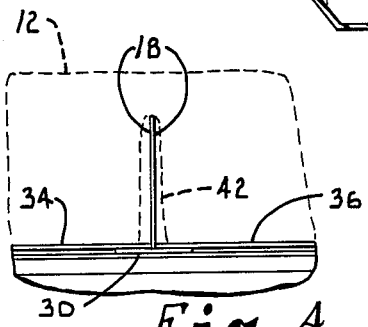
FIG. 4 is an end view of the device seen in FIG. 3 taken along line 4—4 of FIG. 3 and viewing the projecting lower end portion of the device, the snow cover and a drainage channel being shown in broken lines.

The action of each of the devices 10 is illustrated in FIGS. 1 and 4. It should be appreciated in FIG. 1 that the device **10*a* is shown almost completely covered by snow or ice except for a portion of its tail 26*a* as the snow and ice have accumulated in the gutter 14. The lower end portion (approximately one-half of the plate structure) projects from the edge of the roof over the gutter 14. Even with so little of the tail 26*a* exposed as illustrated in FIG. 1, sufficient heat energy is absorbed by the plate to form a drainage channel 42 along the surfaces 18 as illustrated by the broken line in FIG. 4. Therefore, water is permitted to drain from the roof by gravity flow through any ice dam that may be formed at the margin of the roof. Accordingly, the present invention provides an inexpensive and effective means of preventing the accumulation of water on roofs behind ice dams through the use of devices 10** that are easily installed and maintenance free.

Having thus described the invention, what is claimed as new and desired to be secured by Letters Patent is:

1. A device for providing a drainage channel through an ice dam that may form along the margin of an inclined roof, said device comprising:

an elongated, relatively thin, heat-collecting plate of conductive material having a lower longitudinal edge and presenting a pair of opposed major surfaces lying substantially in a common plane, means on said lower edge for mounting said plate on said margin of the roof in an operative position in which the plane of said opposed surfaces is upright and said plate extends longitudinally in a downward direction substantially along the slope of the roof with a lower end portion of the plate projecing from said margin clear of the roof, whereby heating of the plate causes the drainage channel to form along said said surfaces, and said mounting means including a flat mounting strip extending along said lower edge, projecting laterally therefrom in substantially orthogonal relationship to said upright plane, and joined to said lower edge to provide the plate and strip with an inverted T-shaped, transverse configuration adapting the strip to be inserted beneath an adjacent pair of shingles of said roof with the plate extending upwardly therebetween, whereby the device may be held in place by friction of the shingles against the strip.

2. The device as claimed in claim 1, wherein said surfaces are black.

3. The device as claimed in claim 2, wherein said plate is metallic.

4. The device as claimed in claim 1, wherein said plate has an upper longitudinal edge spaced from said lower longitudinal edge a distance such that said surfaces have sufficient vertical expanse to effectively provide said drainage channel.

5. The device as claimed in claim 4, wherein said lower longitudinal edge is straight, and wherein said upper longitudinal edge is generally parallel thereto.

6. The device as claimed in claim 1, wherein said mounting strip has an upper end portion extending beyond said plate for insertion beneath a shingle of the roof above said adjacent pair of shingles.

* * * * *